United States Patent [19]

Yeomans

[11] Patent Number: 4,856,186

[45] Date of Patent: Aug. 15, 1989

[54] APPARATUS AND METHOD FOR DETERMINATION OF CRIMP HEIGHT

[75] Inventor: Michael A. Yeomans, Camp Hill, Pa.

[73] Assignee: AMP Incorporated, Harrisburg, Pa.

[21] Appl. No.: 266,977

[22] Filed: Nov. 4, 1988

[51] Int. Cl.[4] ..... H01R 43/04

[52] U.S. Cl. ..... 29/863; 29/705; 29/720; 29/748

[58] Field of Search ..... 29/407, 857, 863, 705, 29/720, 748; 72/431, 465

[56] References Cited

U.S. PATENT DOCUMENTS

| | | | |
|---|---|---|---|
| 2,780,813 | 2/1957 | Tritt . | |
| 3,584,496 | 6/1971 | Keller | 72/430 |
| 3,783,662 | 1/1974 | Keller et al. | 72/1 |
| 4,294,006 | 10/1981 | Blair et al. | 29/720 X |
| 4,576,032 | 3/1986 | Maack et al. | 72/431 |
| 4,587,725 | 5/1986 | Ogawa et al. | 29/753 |

FOREIGN PATENT DOCUMENTS 0184204 12/1984 European Pat. Off. .

*Primary Examiner*—Timothy V. Eley
*Attorney, Agent, or Firm*—James M. Trygg

[57] ABSTRACT

The present invention is directed to the accurate and automatic determination of crimp height of a terminal being crimped onto a wire. The crimping apparatus includes a conventional crimping press having a reciprocating ram and base, each carrying a mating half of a crimping die set. A strain gage is arranged to measure crimping forces imposed on the terminal being crimped and a linear sensor measures the position of the ram during the crimping process. As the ram descends and the crimping begins, the force as indicated by the strain gage is monitored until it reaches a predetermined value. Monitoring continues until the force reaches substantially zero, at which time the position of the ram, as indicated by the linear sensor, is translated into crimp height.

9 Claims, 5 Drawing Sheets

APPARATUS AND METHOD FOR DETERMINATION OF CRIMP HEIGHT

This invention relates to the crimping of terminals onto wires and particularly to determining the crimp height of such crimped connections.

BACKGROUND OF THE INVENTION

Terminals are typically crimped onto wires by means of a conventional crimping press having an anvil for supporting the electrical terminal and a die that is movable toward and away from the anvil for effecting the crimp. In operation, a terminal is placed on the anvil, an end of a wire is inserted into the ferrule or barrel of the terminal, and the die is caused to move toward the anvil to the limit of the stroke of the press, thereby crimping the terminal onto the wire. The die is then retracted to its starting point.

In order to obtain a satisfactory crimped connection, the "crimp height" of the terminal must be closely controlled. The crimp height of a terminal is a measure of height or maximum vertical dimension of the terminal after crimping. Ordinarily, if a terminal is not crimped to the correct crimp height for the particular terminal and wire combination, an unsatisfactory crimped connection will result. A crimp height variation is not in and off itself the cause of a defective crimp connection, but rather, is indicative of another factor which causes the poor connection. Such factors include using the wrong terminal or wire size, missing strands of wire, wrong wire type, and incorrect stripping of insulation.

Since such defective crimped connections frequently have the appearance of high quality crimped connections, it is difficult to identify these defects so that timely corrective action may be taken.

What is needed is a simple non-destructive means of detecting such defective crimped connections by accurately measuring crimp height during the crimping process in an automation environment.

SUMMARY OF THE INVENTION

The present invention permits the determination of crimp height of a crimped electrical connection, such as a terminal crimped onto a wire by a crimping apparatus. The terminal and element upon which the terminal is to be crimped, are placed in crimping position within the crimping apparatus. The crimping apparatus is actuated to cause a die set to engage and crimp the terminal onto the element. During this crimping step, the force imposed on the terminal is determined and monitored as the force reaches a peak and then recedes to zero. Upon the force reaching substantially zero, simultaneously therewith determining the distance between the terminal engaging portions of the die set, this distance being the crimp height.

BRIEF DESCRIPTION OF THE PREFERRED EMBODIMENT

Figure 1:
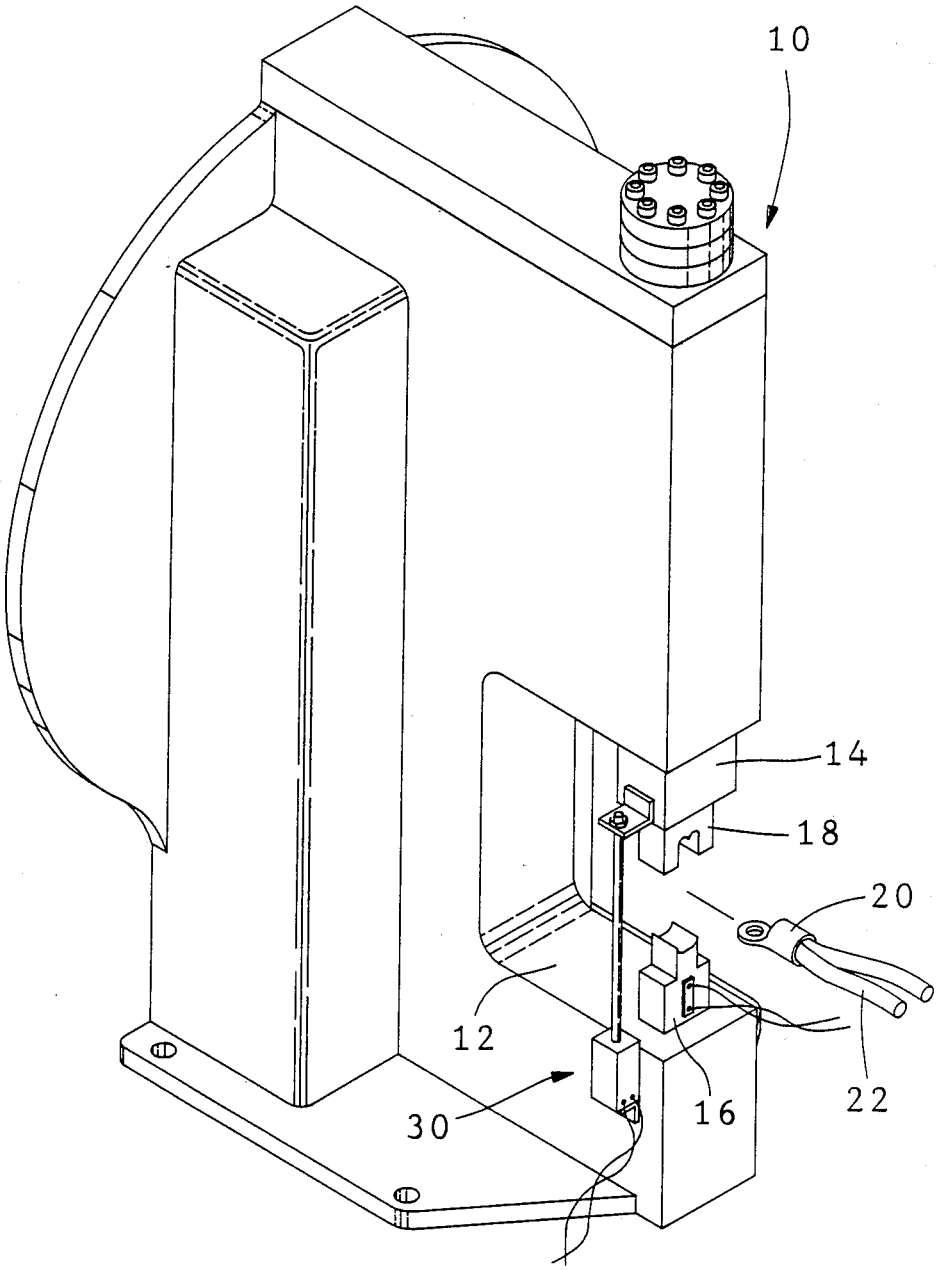
FIG. 1 is an isometric view of a crimping apparatus incorporating the teachings of the present invention.

There is shown in FIG. 1 a crimping press 10 having a base 12 and a ram 14 arranged for reciprocating opposed motion relative to the base 12. It will be understood that a ram 14 reciprocating relative to a base 12 is a conventional arrangement in the industry, and that an alternate arrangement wherein the base 12 reciprocates relative to the ram 14 would also be suitable. The crimping press 10, in the present example, is the type having a flywheel and clutch arrangement for imparting the reciprocating motion to the ram 14 as is more fully described in U.S. Pat. No. 3,550,239 which issued Dec. 29, 1970 to Rider. However, other type presses utilizing reciprocating motion over a suitable stroke distance may be used in the practice of the present invention.

Figure 2:
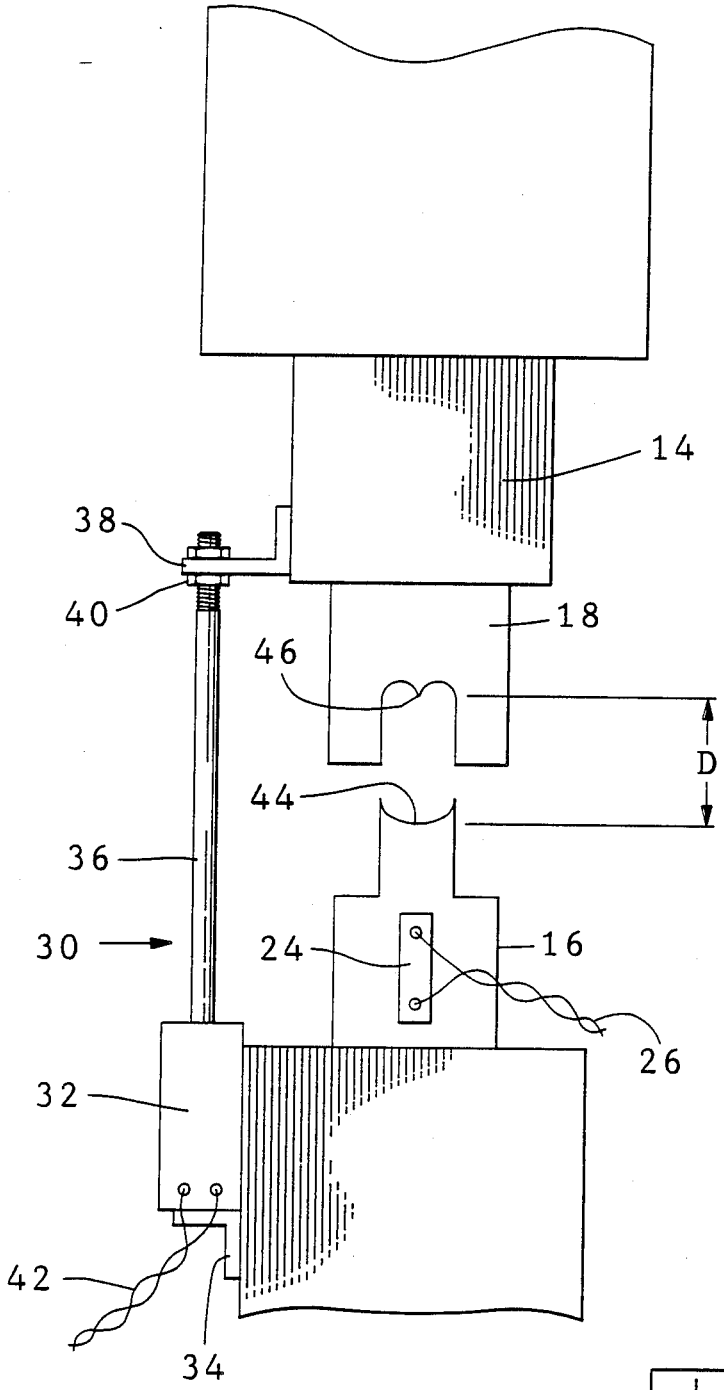
FIG. 2 is a front view of a portion of the apparatus of FIG. 1 showing a crimping die set in an open position.
Figure 3:
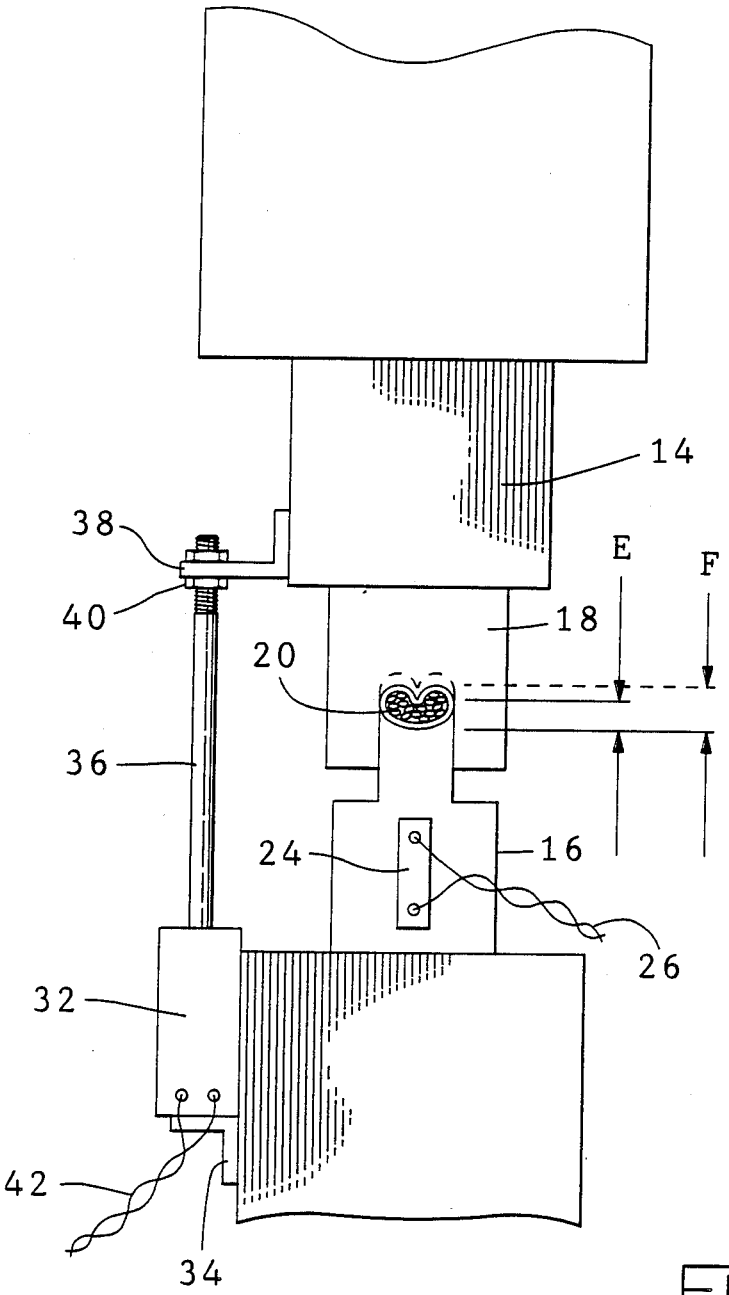
FIG. 3 is a view similar to that of FIG. 2 showing the crimping die set in a closed position.

The base 12 and ram 14 each carry a mating half of a crimping die set in the usual manner. The die set includes an anvil 16 which is removably attached to the base 12 and a punch 18 which is removably attached to the ram 14, as shown in FIGS. 1, 2 and 3. A typical terminal 20 is shown, in FIG. 1, crimped onto a pair of wire leads 22.

As shown in FIGS. 1, 2 and 3, a strain gage 24 is attached to the anvil 16 in the usual manner by epoxy or soldering. The strain gage, in the present example, is gage series CEA, pattern 125UW, manufactured by Micro-Measurements Division, Measurements Group Inc., Raleigh, N.C. 27611. Any similar strain gage may be used. A pair of leads 26 carry a signal that is proportional to the stress placed on the anvil 16 in the vertical direction as sensed by the strain gage 24. The force that produces this stress is transferred from the ram 14, through the terminal 20 and wires 22 being crimped, to the anvil 16. Since virtually all of the stress sensed by the strain gage is a result of force transferred through the terminal 20 and wires 22, the signal appearing on the leads 26 is indicative of the force imposed upon the terminal 20 during crimping.

A linear distance sensor 30 is arranged to measure displacement of the ram 14 with respect to the base 12. The linear distance sensor 30, in the present example, is a linear differential transformer model number 222C-0100, which is manufactured by Robinson-Halpern Company, Plymouth Meeting, Pa. 19462. The sensor 30 includes a stator 32, which is rigidly attached to the base 12 by a suitable bracket 34, and an armature which is movable within the stator in the vertical direction as viewed in FIGS. 2 and 3. A push rod 36 projects upwardly from the stator 32 and has one end attached to the movable armature and the other end adjustably attached to the ram 14 by means of a suitable bracket 38 and adjusting nuts 40. A pair of leads 42 carry a signal that is proportional to the vertical position of the armature within the stator. As the ram 14 is made to undergo reciprocating motion with respect to the base 12, the push rod 36 is required to undergo a similar motion with respect to the stator 32. Since the armature is attached to the pushrod 36, the signal appearing on the leads 42 is indicative of the vertical position of the ram 14 with respect to the base 12. As best seen in FIG. 2, the anvil 16 has a terminal engaging surface 44 and the punch 18 has a terminal engaging surface 46. The dimensional characteristics of the anvil 16 and punch 18 are closely controlled so that the relationship of the surfaces 44 and 46 to the base !2 and ram 14 is known. Since the height of the surface 44 from the base 12 is known, the signal appearing on the leads. 42 is further indicative of the distance D, as shown in FIG. 2, between the terminal engaging portions 44 and 46 of the anvil 16 and punch 18 respectively.

When the ram 14 reciprocates downwardly, as viewed in FIG. 3, the mating die set halves 16 and 18 engage and crimp the terminal 20. During this process, the anvil 16 and punch 18 mutually engage so that when the ram 14 is in its fully down position the terminal engaging portions 44 and 46 of the die set have a minimum distance E therebetween. It will be understood, however, that when in this position, the elasticity of the crimped terminal 20 and wires 22 exert a substantial force outwardly tending to urge the anvil 16 and punch 18 apart. Therefore, as the ram 14 begins to retract upwardly, as viewed in FIG. 3, the crimped terminal 20 and wires 22 expand somewhat still exerting a force against the die set. This expansion continues as the ram 14 retracts further until the crimped terminal 20 and wires 22 reach an equilibrium or limit of elastic expansion and no further force is exerted thereby on the die set. At this point the distance between the terminal engaging portion 44 and 46, indicated as F in FIG. 3, is equal to the crimp height of the crimped connection. Further, this point can easily be recognized by monitoring the signal appearing on the strain gage leads 26. When the signal indicates a zero force, the terminal 20 and wire 22 have reached their limit of elastic expansion and the spacing of the die set halves is as indicated by F in FIG. 3. Since the push rod 36 moves along with the ram 14, the signal appearing on the leads 42 will be proportional to the movement of the ram 14. Therefore, it is a simple matter to correlate this signal to the distance indicated by F. One way to accomplish this would be to place a crimped terminal having a crimp height known to be equal to F and then gently advancing the ram 14 until the surfaces 44 and 46 properly engage the crimped terminal. The nuts 40 are then adjusted until the signal appearing on the leads 42 is calibrated to represent the known distance F. With such an arrangement, the signal would be proportional to and indicative of the crimp height of the terminal 20 crimped onto the wires 22 within a reasonable tolerance range on either side of the distance F. That is, the signal would accurately represent crimp heights from somewhat larger than F down to crimp heights somewhat smaller than F.

Figure 5:
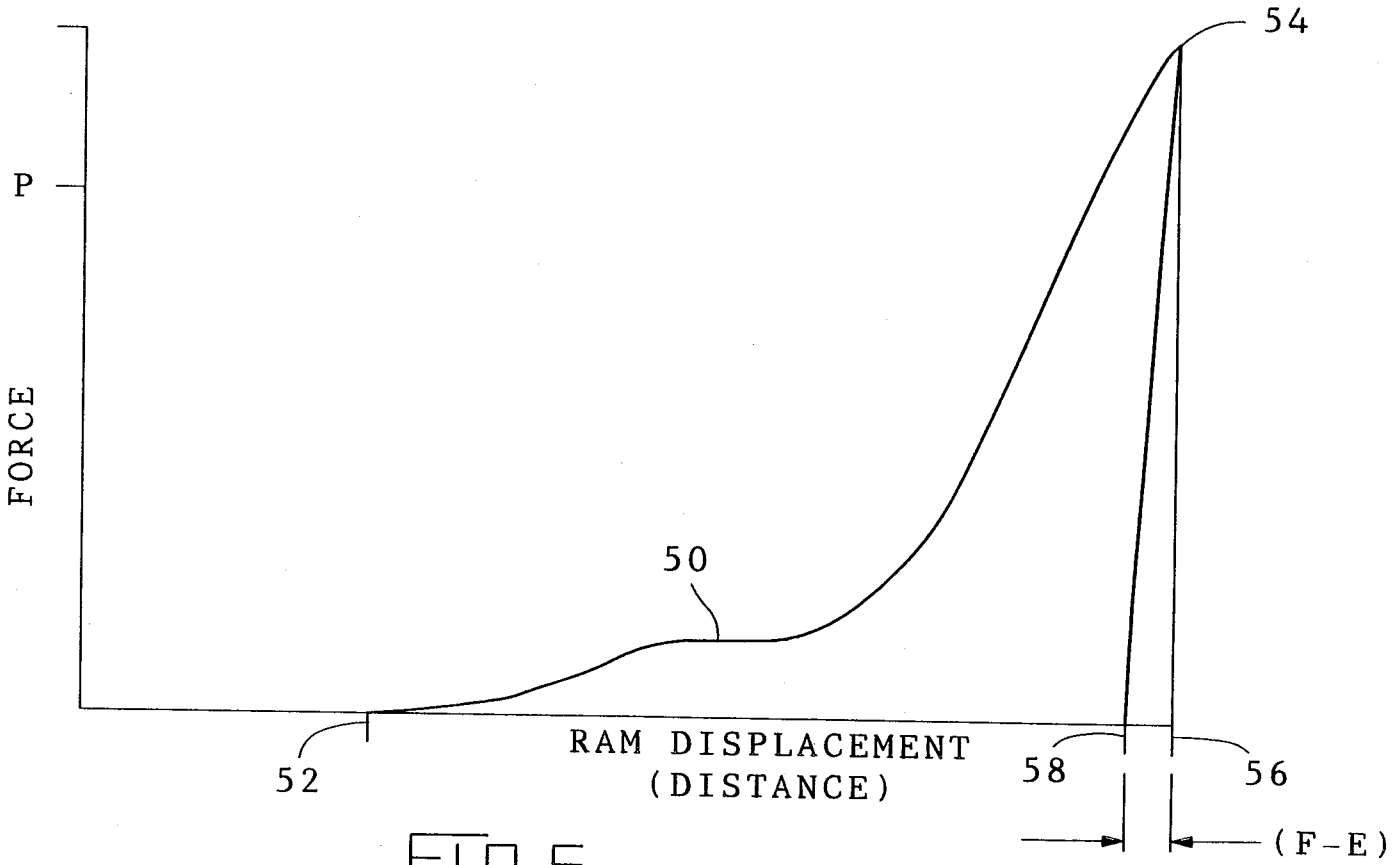
FIG. 5 shows a graph relating crimp force to ram displacement during the crimping of a terminal onto a wire.

FIG. 5 shows a graph 50 which depicts the relationship of crimp force on the terminal with respect to ram displacement. As the ram 14 moves toward the base 12, it reaches the point where the terminal engaging surfaces 44 and 46 are in light engagement with the terminal 20. This point is indicated at 52 along the X axis of the graph 50. As the ram 14 continues its movement, the force exerted on the terminal 20 increases as shown by the graph 50 until a peak force 54 is reached having a ram displacement indicated at 56. This is the point where the ram 14 is in its fully down position, as shown in FIG. 3, and the distance between the surfaces 44 and 46 is indicated as E. As was set forth above, at this point, the terminal 20 is under substantial compressive forces and, being an elastic body, will rebound some amount when the compressive forces are removed. As the ram 14 begins to recede upwardly away from the base 12, the force on the terminal 20 gradually reduces to zero.

This occurs at the point along the X axis indicated at 58. Precisely where this point 58 occurs along the X axis of the graph 50 can be translated to a distance vertically above the surface 44. This is done by sampling the signal present on the leads 42 and translating this signal into a distance. Once the system is properly calibrated, as outlined above, then the signal appearing on the leads 42 at the time the force on the terminal is as indicated at 58, will be indicative of the actual crimp height F.

In operation, the force should be monitored to assure that the crimping operation has actually begun prior to attempting to identify the point 58. This will prevent errors that may occur due to a premature zero reading of zero force prior to the ram 14 passing the point 52. This is illustrated in the block diagram shown in FIG. 4.

Figure 4:
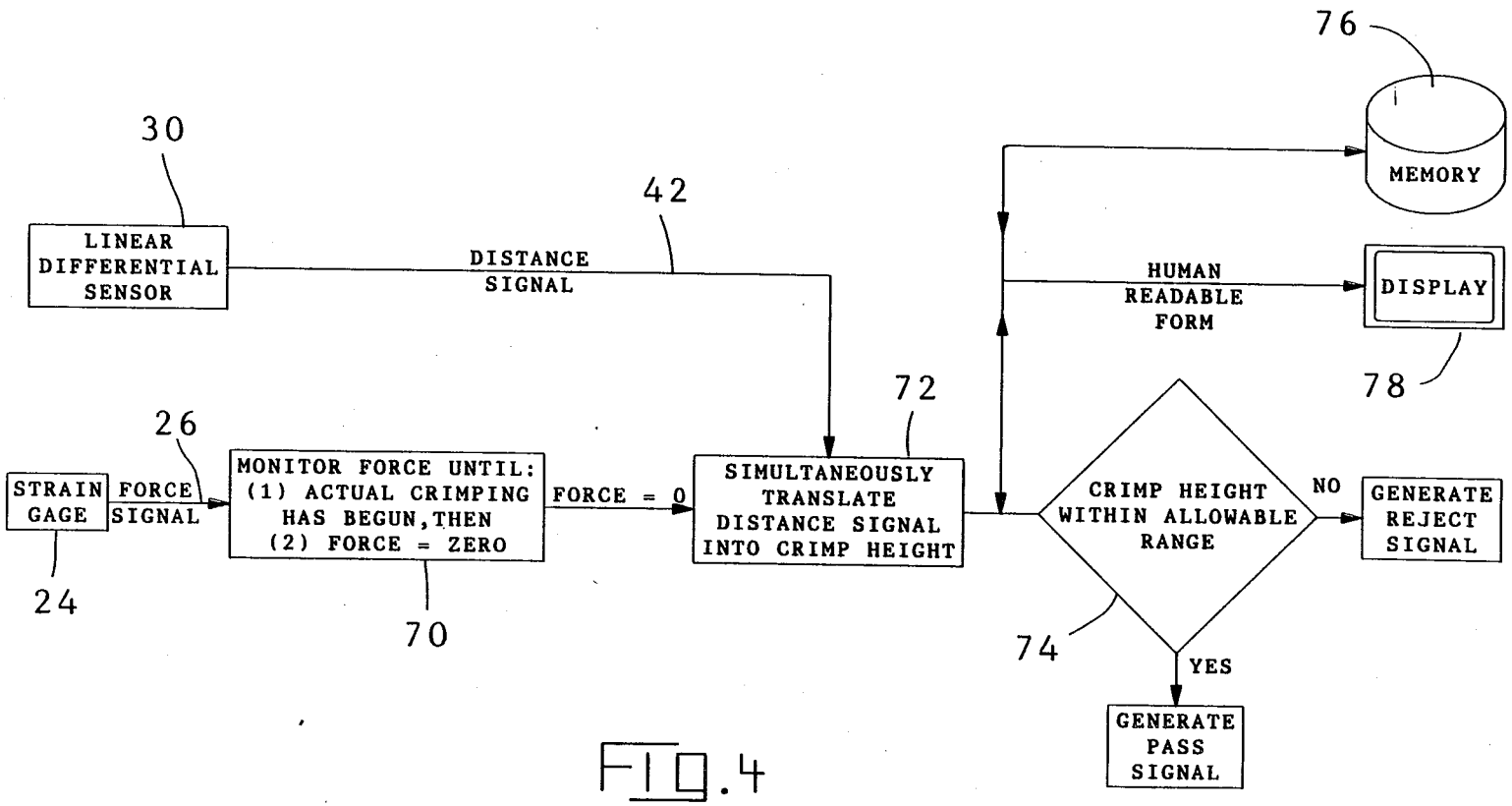
FIG. 4 is a block diagram showing typical functional elements employed in the practice of the present invention.

As shown in FIG. 4, the force signal from the strain gage 24 appearing on the leads 26 is monitored at 70, to assure that the crimping operation has actually begun. This may be done by establishing a force, distance, and perhaps time relationship in the case of a known good crimped connection and then comparing these parameters to the force and distance signals received during the current crimping operation. In the present example, this is done by continually monitoring and comparing the force to a predetermined value indicated as P on the Y axis of the graph 50. When the force becomes greater than P, monitoring continues and the force is repeatedly compared to zero. When the force signal recedes to substantially zero, simultaneously therewith at 72 the distance signal from the linear differential transformer 30 that appears on the leads 42 is translated into crimp height. This is done by simply equating the voltage of the distance signal to a corresponding distance between the ram 14 and the base 12 and then subtracting the length of the die set halves 16 and 18. When calibrating the linear differential transformer 30, as set forth above, the lengths of the die set halves may be factored in so that the voltage output of the transformer 30 will directly correspond to the crimp height F. In any case, the crimp height, as measured in this way, is now examined at 74 to determine whether or not it falls within the allowable range for a high quality crimped connection. In the present example, a standard crimp height was previously stored in a memory 76, which may be a computer ROM or RAM or other machine readable medium that is well known in the industry, see FIG. 4. The measured crimp height is compared, at 74, to this standard crimp height. If the comparison shows that the two are within a predetermined amount then a pass signal is generated, otherwise a reject signal is generated. The pass/reject signals may be coupled to suitable apparatus for automatically directing wires or cables having defective terminations to a reject station for further action by an operator or simply discarding.

When the distance signal from the sensor 30 is translated into crimp height at 72, it may optionally be displayed on a printer, video monitor, or similar output device 78 and it may be stored in the memory 76 for future use is an audit trail or for performance evaluation.

A very substantial advantage of the present invention is the ability to perform a qualitative test on a crimped connection at the instant that the connection is made. This permits such testing during the manufacturing process in an automated environment and the automatic rejection of crimped connections that fail the test. Another advantage is the ability to store the results of such testing for the purpose of providing a historical audit trial in the event of machine malfunction or to monitor tooling wear. Additionally, such historic data may be useful in various performance analysis.

I claim:

1. In a method of determining the crimp height of a terminal crimped onto an element utilizing crimping apparatus which includes a press having a base and a ram arranged for opposing relative reciprocating motion, said base and ram each carrying a mating half of a crimping die set, the steps comprising;

(a) placing a terminal and element in crimping position within said crimping apparatus;

(b) causing at least one of said base and said ram to undergo relative motion so, that said die set engages and crimps said terminal onto said element; and (c) during step (b) determining that the crimping process has actually begun and then monitoring the force imposed on said terminal as said force recedes from a predetermined value to zero, whereupon said force reaching substantially zero, simultaneously therewith determining the distance between the terminal engaging portions of said die set, said distance being said crimp height.

2. The method according to claim 1 wherein said determining that the crimping process has actually begun includes monitoring the force imposed on said terminal as the force reaches a desired value.

3. The method according to claim 2 wherein said crimping apparatus includes means for generating both a force signal indicative of said force imposed on said terminal and a distance signal indicative of said distance between the terminal engaging portions of said die set, wherein step (c) includes:

(C1) comparing said force signal to a first reference signal that represents zero, and (C2) when said force signal is substantially equal to said first reference signal, comparing said distance signal to a second reference signal that represents a desired crimp height and if the difference between said signals exceeds a predetermined amount, generating a reject signal.

4. The method according to claim 3 wherein said crimping apparatus includes a memory and (C2) includes storing said force signal into said memory.

5. The method according to claim 4 including: step (d) translating said distance signal into human readable format.

6. In a machine for crimping a terminal onto an element including a press having a base and a ram arranged for opposed relative reciprocating motion, said base and ram each carrying a mating half of a crimping die set, apparatus for determining the crimp height of a terminal crimped onto an element comprising:

(a) force means for determining and monitoring the force imposed on said terminal during crimping thereof; and (b) distance means for determining the distance between the terminal engaging portions of said die set when said determined force is substantially equal to zero.

7. The machine according to claim 6 wherein said distance means comprises a linear differential transformer having a stator, an armature, and means for generating a first signal indicative of the relative position of said stator and armature, wherein one of said stator and armature is attached to said base and the other is attached to said ram.

8. The machine according to claim 7 wherein said force means is arranged to generate a second signal indicative of the force imposed on said terminal during said crimping thereof and continuously comparing said second signal to a reference signal indicative of zero until said second signal is substantially equal to zero.

9. The machine according to claim 8 wherein said force means is a strain gauge and wherein said machine includes means for communicating said distance to an operator.

* * * * *

UNITED STATES PATENT OFFICE

CERTIFICATE OF CORRECTION

Patent No. 4,856,186 Dated August 15, 1989

Inventor(s) Michael A. Yeomans

It is certified that error appears in the above-identified patent and that said Letters Patent is hereby corrected as shown below:

In claim 4, column 6, line 4, after the word "and" add the word --step--.

Signed and Sealed this

Seventeenth Day of July, 1990

*Attest:*

HARRY F. MANBECK, JR.

*Attesting Officer*

*Commissioner of Patents and Trademarks*